US006422885B2

(12) United States Patent
Kain et al.

(10) Patent No.: US 6,422,885 B2
(45) **Date of Patent: *Jul. 23, 2002**

(54) CONNECTOR ASSEMBLY ADAPTED FOR AXIAL REALIGNMENT

(75) Inventors: Steven Edward Kain; John Edward Lucius, both of Glendale, AZ (US)

(73) Assignee: The Whitaker Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 14 days.

(21) Appl. No.: 09/119,413

(22) Filed: Jul. 20, 1998

(51) Int. Cl.[7] ..... H01R 13/64
(52) U.S. Cl. ..... 439/247; 439/248
(58) Field of Search ..... 439/247, 248, 439/901

(56) References Cited

U.S. PATENT DOCUMENTS

| | | | | | |
|---|---|---|---|---|---|
| 2,954,543 | A | * | 9/1960 | Rayer et al. | 439/248 |
| 3,524,160 | A | | 8/1970 | Robinson | 339/34 |
| 3,651,444 | A | | 3/1972 | Desso et al. | 339/42 |
| 3,951,500 | A | | 4/1976 | Anderson | 339/64 |
| 3,964,814 | A | | 6/1976 | Kalbitz et al. | 339/64 |
| 4,227,765 | A | * | 10/1980 | Neumann et al. | 439/248 |
| 4,361,372 | A | * | 11/1982 | Majkrzak et al. | 439/247 |
| 4,580,862 | A | | 4/1986 | Johnson | 339/64 |
| 4,647,130 | A | * | 3/1987 | Blair et al. | 439/248 |
| 4,664,456 | A | | 5/1987 | Blair et al. | 339/14 |
| 4,722,691 | A | * | 2/1988 | Gladd et al. | 439/248 |
| 4,842,537 | A | | 6/1989 | Villiers | 439/246 |
| 5,057,030 | A | * | 10/1991 | Hutson et al. | 439/247 |
| 5,080,604 | A | * | 1/1992 | Rider et al. | 439/247 |
| 5,197,896 | A | | 3/1993 | Landis et al. | 439/247 |
| 5,199,900 | A | * | 4/1993 | Hayes, Sr. | 439/247 |
| 5,201,663 | A | * | 4/1993 | Kikuchi et al. | 439/248 |
| 5,306,169 | A | * | 4/1994 | Fukushima et al. | 439/248 |
| 5,383,790 | A | | 1/1995 | Kerek et al. | 439/248 |
| 5,397,244 | A | | 3/1995 | Generoli et al. | 439/248 |
| 5,605,150 | A | * | 2/1997 | Radons et al. | 439/247 |
| 5,620,329 | A | * | 4/1997 | Kidd et al. | 439/248 |
| 5,873,746 | A | * | 2/1999 | Morlion et al. | 439/247 |
| 5,921,796 | A | * | 7/1999 | Morlion et al. | 439/247 |
| 5,997,328 | A | * | 12/1999 | Kodama et al. | 439/247 |
| 6,033,246 | A | * | 3/2000 | Gilbert | 439/248 |

FOREIGN PATENT DOCUMENTS

| | | | |
|---|---|---|---|
| WO | WO 97/28579 | 8/1997 | H01R/9/09 |

OTHER PUBLICATIONS

Search Report under Section 17, Application No. GB 9916646.4, Date of Search Jan. 17, 2000.
AMP Metrimate Pin and Socket Connectors, p. 18, Catalog 82045, dated Mar. 1998.

* cited by examiner

*Primary Examiner*—Renee Luebke
*Assistant Examiner*—James R. Harvey

(57) ABSTRACT

An electrical connector assembly (1) for establishing a mated electrical connection with a plug-in unit (2), has an electrical connector (5) mounted on rails (16), and a resilient spring mechanism (19) urged in compression in response to movement of the connector (5) rearwardly to realign its position when mated with an inaccurately aligned plug-in unit (2).

13 Claims, 2 Drawing Sheets

CONNECTOR ASSEMBLY ADAPTED FOR AXIAL REALIGNMENT

FIELD OF THE INVENTION

The invention relates to an electrical connector that adjusts its position to realign with a misaligned, mating electrical connector.

BACKGROUND OF THE INVENTION

U.S. Pat. No. 5,197,896 discloses a known connector assembly that extends within an enlarged opening through a panel. The known connector assembly fits loosely in the enlarged opening, which permits the connector assembly to adjust its position by movement laterally within the confines of the enlarged opening. However, the known connector assembly is unable to adjust its position relative to an axial direction of mating, for example, to realign its position along an axis that extends perpendicular to the panel. A further limitation of the known connector assembly resides in the need for an enlarged opening through a panel. The opening would be unsuitable for use in a circuit board type of panel. A circuit board type of panel provides electrical circuit paths on its exterior surface areas, and additional circuit paths that could be present along areas that are imbedded beneath the exterior surface areas. The presence of an enlarged opening through the panel would largely reduce the areas available for the circuit paths. Further, a connector assembly, that would be encircled by an opening, would be unable to bridge across the opening and connect electrically with the circuit paths.

A need exists in computers, office equipment and machine control equipment for a connector assembly that mounts to a circuit board type of panel and connects with electrical circuit paths on the circuit board.

A further need exists for a connector assembly that is able to adjust its position relative to an axial direction of mating.

Computers are commercially available in the form of a docking station and one or more plug-in portable units that plug to and unplug from the docking station. The docking unit provides electrical power and electronic circuit connections that connect to the plug-in portable unit. The portable unit can take the form of any of a variety of electronic devices. For example, the portable unit can be a device primarily for recording and storing electronic data, such as, an electronic meter reading device, and a personal digital assistant device. The portable plug-in unit further can be as complex as a personal computer that is removable from the docking station for portable use. When the portable plug-in unit is plugged into the docking station, an electrical connection must be made with an electrical connector assembly on the docking station.

Such a connector assembly is required to establish an electrical mating connection with a plug-in unit, when the connector assembly is partially obscured behind a panel, behind an electrical shield, behind a safety barrier, or behind the plug-in unit itself. This is known as, establishing a blind mate connection.

It would be desirable for the connector assembly to establish a blind mate connection with ease. A need exists, not only in computers, but also, in office equipment and machine control equipment for a connector assembly that mounts to a circuit board type of panel, and that connects electrically with circuit paths on the circuit board type of panel, and that establishes a blind mate connection with ease.

U.S. Pat. No. 5,080,604, discloses a known electrical connector assembly comprising, a hood together with an electrical connector having a mating end aligned axially with the receptacle. The hood has a receptacle to align with alignment posts projecting from a mating electrical connector on a plug-in unit. The hood acts as a funnel to receive tapered tips on the alignment posts, and to realign with the alignment posts as the alignment posts are fully inserted into the hood. Although the known connector assembly accomplishes realignment of the hood with the mounting posts, no provision is made to assure that the mounting posts are substantially inserted to the full extent necessary. Further, no provision is made to realign the known electrical connector in the direction of mating connection, to compensate for overtravel of the posts within the hood. Accordingly, a further need exists for a connector assembly that is adjustable in position in its direction of mating connection to establish a blind mating connection with ease.

There is a growing trend toward having a single electrical connector that combines, both the electrical power, and the electronic communications, in a single connector assembly mounted on a panel. A connector assembly is known as a hybrid connector assembly, for its combination of electrical power connections with electronic communications connections in a single connector assembly. The connector assembly must have electrical contacts that conduct electrical power, combined with electrical contacts that transmit electronic communications signals. Another growing trend resides in providing a number of interchangeable plug-in units of machine tools that are combined in plug-in fashion, using hybrid connector assemblies, to an electrical power buss, such as, a DIN rail, for example, and to a communications buss that is known in many communications systems, for example, a local area network. A hybrid connector assembly is used on each of the plug-in units to connect the interchangeable plug-in unit to the electrical power and the communications signals that control machine functions. A hybrid connector assembly eliminates the number of electrical connectors that would be required to connect any one plug-in unit to respective sources of power and communication signals.

SUMMARY OF THE INVENTION

An electrical connector assembly according to the invention is suitable for use in office equipment and machine tool controls that are in the form of plug-in units to plug in, and unplug from, electrical outlets that supply electrical power and electronic communications signals.

According to the invention, a connector assembly is mounted on a panel for adjustable movement, to realign its position relative to an axial direction of mating with an inaccurately aligned plug-in unit.

Further, according to the invention, a connector assembly adjusts its position axially in the direction of mating to realign with an inaccurately aligned plugin unit, to establish a mating connection.

Further, according to the invention, a connector assembly is mounted on a panel for adjustable movement, to establish an electrical blind mate connection with a plug-in unit.

The invention establishes a blind mate connection with a plug-in unit, when the connector assembly is partially obscured behind a panel, behind a safety barrier, or behind the plug-in unit itself.

Further, according to the invention, the connector assembly adjusts its position axially in the direction of mating connection, to realign with an inaccurately aligned plug-in unit, and establish a blind mate connection with the plug-in unit.

An embodiment of the invention will now be described by way of example, with reference to the accompanying drawings, according to which:

DETAILED DESCRIPTION

Figure 1:
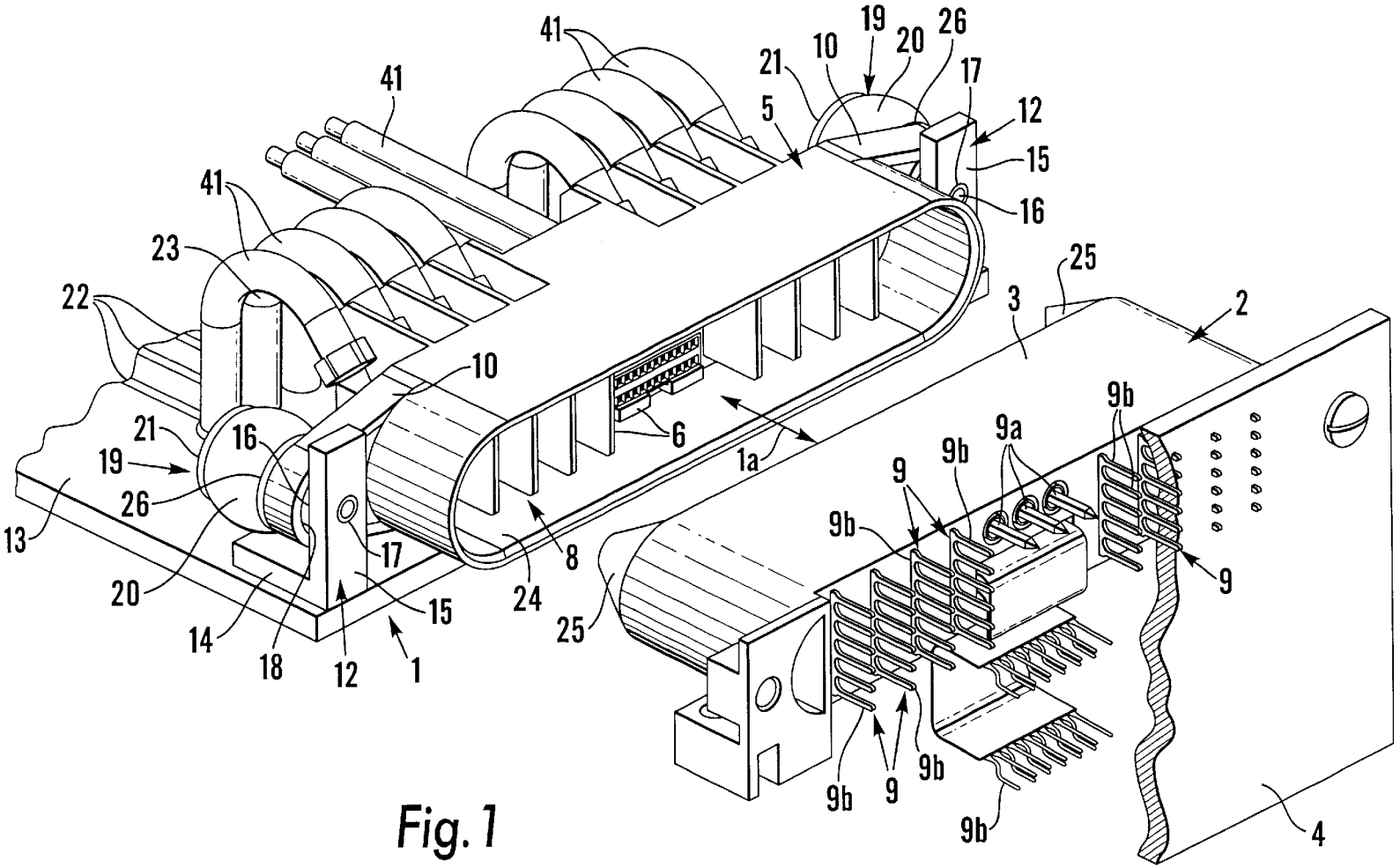
FIG. 1 is an isometric view of an electrical connector assembly mounted on a circuit board, and a separate mating connector assembly mounted on a circuit board, with the circuit boards being broken away.

With reference to FIG. 1, an electrical connector assembly 1 establishes an electrical connection to a plug-in unit 2. The plug-in unit 2 comprises, in part, a mating electrical connector assembly 3 mounted on a circuit board 4. When the plug-in unit 2 is moved toward the connector assembly 1, along an axis of mating 1*a*, the connector assembly 1 mates with the mating electrical connector assembly 3. A mating electrical connection is established between the connector assembly 1 and the mating electrical connector assembly 3.

Figure 2:
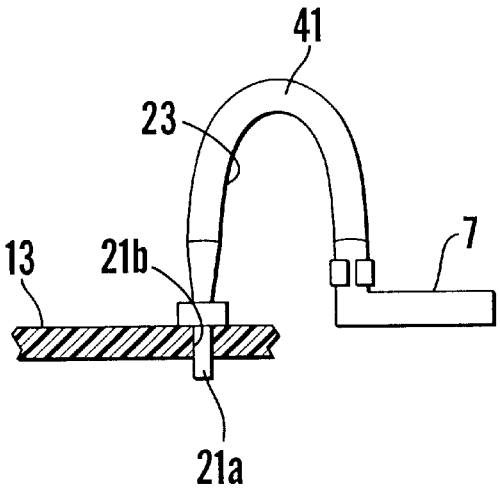
FIG. 2 is a fragmentary side view in section of a flexible conductor extending from an electrical contact to a circuit board.

The electrical connector assembly 1 comprises, an electrical connector 5 having an insulating housing 6 having multiple segments, and electrical contacts 7, FIG. 2, in the housing 6. The housing 6 has a mating end 8. The contacts 7 extend toward the mating end 8 to establish electrical connections with mating electrical contacts 9 in the mating electrical connector assembly 3. The mating electrical contacts 9 are electrically connected to the circuit board 4 in a known manner.

With reference to FIG. 1, the connector assembly 1 has laterally extending mounting flanges 10. A corresponding enlarged opening 18 through each of the mounting flanges 10 extends parallel to the axis of mating 1*a*.

With reference to FIG. 1, the connector assembly 1 further comprises, a mounting bracket 12 on a circuit board 13 has a circuit board engaging portion 14 and a corresponding connector mounting portion 15 that upstands from the circuit board engaging portion 14. As shown, the mounting portion 15 is divided into two parts, and the bracket 12 is divided into two parts, although the two parts of the bracket 12 can be joined together as a single part.

A cylindrical rail 16 projects from each corresponding connector mounting portion 15. For example, each rail 16 is press fit in a bore 17 through the corresponding mounting portion 15. The rails 16 carry the electrical connector 5, and mount the electrical connector 5 on the circuit board 13. Each rail 16 projects through a corresponding enlarged opening 18 through a corresponding mounting flange 10 on the electrical connector 5.

A resilient spring mechanism 19 will now be described. The resilient spring mechanism 19 comprises, for example, each corresponding rail 16, and a spring member 20 that is resilient in compression, and that is moveably mounted on a free end of the rail 16, and an enlarged cap 21 on the terminus of the free end of the rail 16. The cap 21 overlaps a rear end of the spring member 20 to prevent removal of the spring member 20. The spring member 20 is positioned between the cap 21 and the flange 10 on the electrical connector 5, and is adapted to be in resilient compression when the electrical connector 5 of the connector assembly 1 is moved rearwardly in a manner that will now be described.

With reference to FIG. 1, the plug-in unit 2 is required to move toward the electrical connector assembly 1, along the axis of mating 1*a*, to establish a mating connection of the electrical connector assembly 1 with the mating electrical connector assembly 3. The amount of axial movement can vary, for example, because of changes in dimensions as the result of manufacturing tolerances and temperature changes. To compensate for variations in axial movement of the plug-in unit 2, the connector assembly 1 is adapted to move along the axis of mating 1*a* to realign itself into a variety of positions along the axis of mating 1*a*. Should the mating connector assembly 3 overtravel, that is, exceed its desired amount of axial movement toward the electrical connector assembly 1, the electrical connector 5 is moveable by sliding along the rails 16, in a direction rearwardly along the axis of mating 1*a* to realign itself axially with the axially overtraveled mating connector assembly 3. A wide variation in movement is permissible, to avoid damage due to overtravel of the plug-in unit 2, and to avoid an incomplete mating of the connector assembly 1 and the mating electrical connector assembly 3 due to a deficient amount of axial movement in the direction of mating.

Rearward axial movement of the electrical connector 5 opposes a spring bias provided by the spring mechanism 19. The spring mechanism 19 provides the spring bias to urge the electrical connector 5 forwardly along the rails 16, which urges the housing 6 and the electrical contacts 7 forwardly along the rails 16 in a direction of mating, to provide sufficient pressure to establish the desired mating with the mating electrical connector assembly 3. The spring mechanism 19 is urged to contract resiliently in response to movement of the connector 5 rearwardly along the axis of mating 1*a*, and rearwardly along the rails 16 to realign with a plug-in unit 2 that is inaccurately positioned along the axis of mating.

With reference to FIG. 1, the spring member 20 can take any of many forms that are resilient in compression, for example, a coil spring or a leaf spring. As shown in FIG. 1, the spring member 20 is a bulbous body of resilient elastomer material slidable on a free end of the rail 16. The passage of the bulbous body is slidably received over a corresponding rail 16. The spring member 20 is resilient under compression between the flange 10 on the connector 5 and the cap 21 on the corresponding rail 16, particularly when the connector 5 is moved rearward axially to realign its position. The spring member 20 tends to expand resiliently to provide the spring bias.

Figure 3:
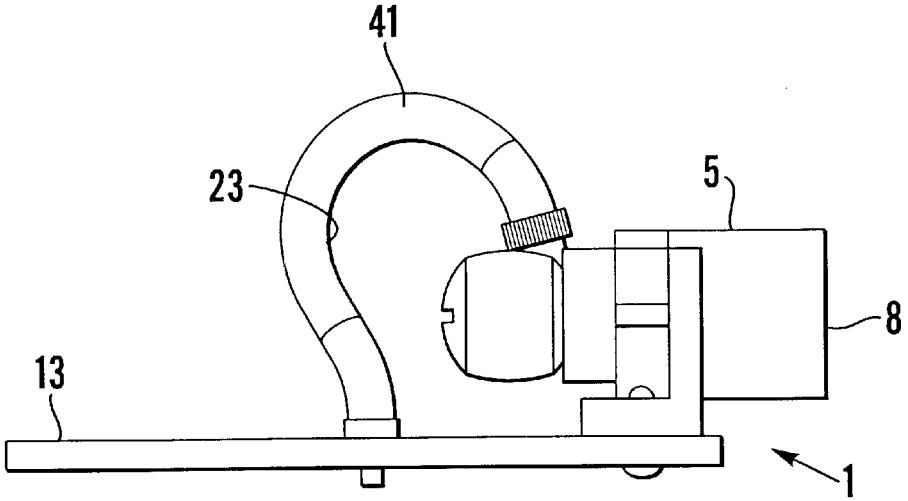
FIG. 3 is a side view of the electrical connector assembly as shown in FIG. 1.

With reference to FIG. 2, each of the contacts 7 has a flexible conductor 41 connected to the circuit board 13. With reference to FIG. 3, the flexible conductors 41 extend from the contacts 7 to the circuit board 13, where the flexible conductors 41 connect to conducting circuit paths 22, FIG. 1, on the circuit board 13. The flexible conductors 41 extend in flexible, open loops 23 for connection to the circuit board 13 on which the bracket 12 is mounted. The flexible conductors 41 undergo flexure when the connector 5 moves to realign its position, such that the loops 23 begin with the opposite ends of such loops 23 being spaced widely apart, and become less widely spaced apart, as the connector 5 moves rearwardly. For example, the flexible conductors 41 comprise insulation covered wires having multiple thin strands of wire that are more flexible than a single thick strand of wire. The wires project from opposite ends of the insulation, and are gathered into a bundle. The bundle becomes a single slug 21*a*, for example, by being impregnated with solder, or by fitting in a hollow sleeve of metal, which is easily plugged into a corresponding aperture 21*b*, FIG. 3, in the circuit board 13.

With reference to FIG. 1, a hood 24 on the housing projects forwardly of the mating end 8 on the housing 6. The mating end 8 of the housing 6 is recessed within the hood 24. The hood 24 provides a hollow receptacle to align with spaced apart alignment posts 25 that project from the mating electrical connector 3 of the plug-in unit 2. The alignment posts 25 have tapered tips.

Lateral movement of the connector assembly 1 will now be described with reference to FIG. 1. The enlarged passages 18 through the flanges 10 on the connector 5 are free to orbit eccentrically about the center axes of the corresponding rails 16, which mounts the connector 5 for orbital movement laterally of its axis of mating 1*a* with the mating electrical connector assembly 3. Should the alignment posts 25 be misaligned laterally during movement of the plug-in unit 2 toward the connector assembly 1, the tapered tips on the alignment posts 25 will partially enter the hood 24 and bias against the hood 24 to cause lateral movement of a moveable unit comprising the hood 24 and the housing 6 and the contacts 7, which realigns the connector 5 of the connector assembly 1 laterally, in its position, to realign itself with the laterally misaligned mating connector assembly 3.

With reference to FIG. 1, the connector assembly 1 is a hybrid connector that has the electrical contacts 7 comprising electrical power contacts 7 for conducting power to corresponding power contacts 9*a* in the mating connector assembly 3, and electrical signal contacts 7 for transmitting electrical signals to corresponding signal contacts 9*b* in the mating electrical connector assembly 3.

An embodiment of the invention has been described, other embodiments and modifications of the invention are intended to be covered by the spirit and scope of the appended claims.

What is claimed is:

1. An electrical connector assembly for connection with a mating electrical connector comprising:

an insulating housing connected to a hood to align with alignment posts projecting from the mating electrical connector, the housing having a mating end on the insulating housing aligned axially with the mating electrical connector, conducting electrical contacts in the insulating housing, the contacts extending toward the mating end on the housing for mating connection with respective electrical contacts on the mating electrical connector, a moveable unit comprising the hood and the insulating housing and the electrical contacts, the moveable unit being mounted moveably on a circuit board for movement relative to the circuit board, and flexible wire conductors extending from the electrical contacts away from the insulating housing to respective electrical circuit paths on the circuit board, the flexible wire conductors being flexed by movement of the moveable unit to realign itself with the mating electrical connector, and, thus, establish an electrical blind mate connection with the mating electrical connector.

2. An electrical connector assembly as recited in claim 1 wherein, the electrical contacts comprise signal transmitting contacts and electrical power conducting contacts, and the electrical circuit paths on the circuit board comprise signal transmitting circuit paths and power conducting circuit paths.

3. An electrical connector as recited in claim 1, and further comprising: a bracket having a circuit board engaging portion and rails extending rearwardly of the mating end, the moveable unit being reciprocatingly received along the rails, and a resilient spring mechanism mounted on the bracket and urging the moveable unit forwardly along the rails, and the resilient spring mechanism being urged to contract in response to movement of the moveable unit rearwardly along the rails to realign the moveable unit with the mating electrical connector.

4. An electrical connector as recited in claim 1, and further comprising: the flexible wire conductors extending in flexible loops for connection to the circuit board, the loops undergoing flexure in response to movement of the moveable unit.

5. An electrical connector as recited in claim 1, and further comprising: a bracket having a circuit board engaging portion and rails extending rearwardly of the mating end, the moveable unit being reciprocatingly received along the rails, the rails being received through enlarged openings through a flange on the housing, and a resilient spring mechanism mounted on the bracket and urging the moveable unit forwardly along the rails, and the resilient spring mechanism being urged to contract in response to movement of the moveable unit rearwardly along the rails to realign the moveable unit with the mating electrical connector.

6. An electrical connector as recited in claim 1, and further comprising: a bracket having a circuit board engaging portion and rails extending rearwardly of the mating end, the movable unit being reciprocatingly received along the rails, the rails being received through enlarged openings through a flange on the housing, and a resilient spring mechanism mounted on the bracket and urging the moveable unit forwardly along the rails, the resilient spring mechanism comprises resilient bulbous bodies on the rails and engaging the flange, and the resilient spring mechanism being urged to contract in response to movement of the moveable unit rearwardly along the rails to realign the moveable unit with the mating electrical connector.

7. An electrical connector assembly for establishing an electrical connection with a mating electrical connector on a plug-in unit, comprising:

an electrical connector having an insulating housing having a mating end and electrical contacts in the housing, the electrical contacts extending toward the mating end, a bracket having a circuit board engaging portion and rails extending rearwardly of the mating end, the housing being reciprocatingly received along the rails, a resilient spring mechanism mounted on the bracket and urging the housing and the mating end forwardly along the rails, the resilient spring mechanism being urged to contract in response to movement of the housing rearwardly along the rails to realign the electrical connector with the plug-in unit that exceeds its axial travel toward the eletrical connector, and to establish a blind mate connection with the mating electrical connector on the plug-in unit, and a hood on the housing, the hood to align with alignment posts projecting from the mating electrical connector on the plug-in unit, a movable unit comprising the hood and the housing and the contacts, the movable unit being mounted on the rails for movement rearwardly of the rails and relative to a circuit board on which the bracket is mounted, and flexible conductors connecting the electrical contacts with respective circuit paths on the circuit board, the flexible conductors undergoing flexure upon movement of the movable unit rearwardly of the rails.

8. An electrical connector assembly as recited in claim 7, and further comprising: flexible insulated conductors connected to the contacts and extending in flexible loops for connection to a circuit board on which the bracket is mounted, the loops undergoing flexure in response to movement of the connector.

9. An electrical connector assembly as recited in claim 7 wherein, the spring mechanism comprises resilient bulbous bodies of elastomer material engaging the connector.

10. An electrical connector assembly as recited in claim 7 wherein, the spring mechanism comprises resilient bulbous bodies on the rails, the bodies engaging the connector.

11. An electrical connector assembly as recited in claim 7, and further comprising: a hood on the housing, the hood to align with alignment posts projecting from a mating electrical connector on a plug-in unit.

12. An electrical connector assembly for connection with a mating electrical connector comprising:

an insulating housing having a mating end aligned axially with the mating electrical connector, conducting electrical contacts in the insulating housing, the contacts extending toward the mating end for mating connection with respective electrical contacts on the mating electrical connector, a moveable unit comprising the insulating housing and the electrical contacts, the moveable unit being mounted moveably on rails attached to a bracket engaged with the circuit board and extending rearwardly of the mating end, the bracket having a resilient spring mechanism mounted thereon and urging the moveable unit forwardly along the rails, the resilient spring mechanism being forced to contract in response to movement of the moveable unit rearwardly long the rails, and flexiable conductors extending from the electrical contacts to respective electrical circuit paths on the circuit board, the flexible conductors being flexed by movement of the moveable unit.

13. An electrical connector as recited in claim 12, and further comprising: the flexible conductors extending in the flexible loops for connection to the circuit board, the loops undergoing flexure in response to the movement of the moveable unit.

* * * * *